US007128620B2

(12) United States Patent
Maura et al.

(10) Patent No.: US 7,128,620 B2
(45) Date of Patent: Oct. 31, 2006

(54) ELEMENT FOR CONNECTING A FLEXIBLE CONDUCTOR AND METHOD FOR CONNECTING A FLEXIBLE CONDUCTOR TO A CONNECTION TERMINAL

(75) Inventors: Massimo Maura, Ceccano (IT); Federico Gamba, Bergamo (IT)

(73) Assignee: ABB Service S.r.l.(IT)

( * ) Notice: Subject to any disclaimer, the term of this patent is extended or adjusted under 35 U.S.C. 154(b) by 0 days.

(21) Appl. No.: 10/510,601

(22) PCT Filed: Apr. 11, 2003

(86) PCT No.: PCT/EP03/03877

§ 371 (c)(1),
(2), (4) Date: Oct. 12, 2004

(87) PCT Pub. No.: WO03/088288

PCT Pub. Date: Oct. 23, 2003

(65) Prior Publication Data

US 2006/0121799 A1 Jun. 8, 2006

(30) Foreign Application Priority Data

Apr. 12, 2002 (IT) ..... MI2002A0789

(51) Int. Cl.
*H01R 4/02* (2006.01)

(52) U.S. Cl. ..... 439/874; 219/121.64

(58) Field of Classification Search ..... 219/121.63, 219/121.64; 439/874; 174/84 R
See application file for complete search history.

(56) References Cited

U.S. PATENT DOCUMENTS 4,583,065 A * 4/1986 Favre-Tissot ..... 335/106
4,774,394 A 9/1988 Lemke
5,163,221 A * 11/1992 Favre-Tissot et al. ..... 29/860
5,300,755 A * 4/1994 Nishitani et al. ..... 219/121.63
6,121,560 A * 9/2000 Turkmen ..... 200/271
6,531,676 B1 * 3/2003 Schwemmer et al. .. 219/121.64
6,761,598 B1 * 7/2004 Onizuka et al. ..... 439/876
2001/0011418 A1 8/2001 Manfred et al.

FOREIGN PATENT DOCUMENTS

EP 0 887 884 A 12/1998

* cited by examiner

*Primary Examiner*—Neil Abrams
(74) *Attorney, Agent, or Firm*—Connolly Bove Lodge & Hutz LLP

(57) ABSTRACT

A junction between a flexible conductor and a connection terminal is disclosed. The junction includes a connection terminal that is shaped substantially like a parallelepiped and has an upper face and a lower face, a pair of side faces and an end face. The connection terminal includes, on the end face, one or more slots shaped substantially like a parallelepiped, which run through the entire thickness of the connection terminal. The junction further includes at least one flexible conductor, in which one end part is shaped so as to mate substantially with the inner walls of the slots. The end part of the flexible conductor is inserted in the slots and cold coined, and the flexible conductor protrudes substantially at right angles from one of the upper, lower or end faces. At least one laser welding bead runs across the two slots along two of the faces from which the flexible conductor does not protrude.

28 Claims, 1 Drawing Sheet

Figure 1:
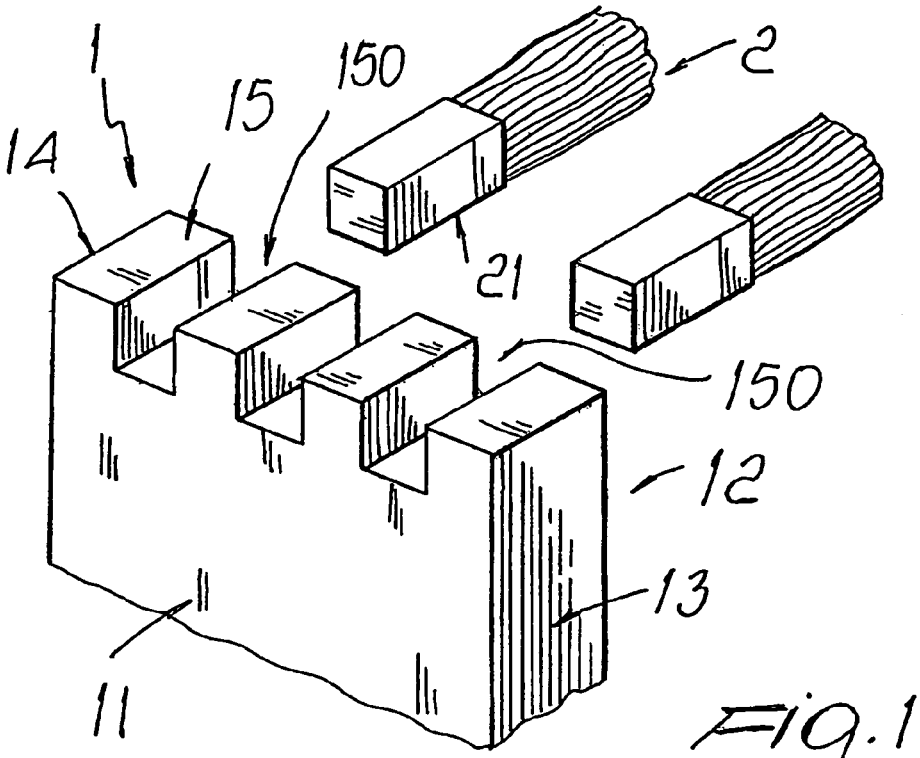

ELEMENT FOR CONNECTING A FLEXIBLE CONDUCTOR AND METHOD FOR CONNECTING A FLEXIBLE CONDUCTOR TO A CONNECTION TERMINAL

DESCRIPTION

The present invention relates to an element for connecting flexible conductors, particularly for low-voltage circuit breakers and contactors, and to a method for connecting a flexible conductor, particularly one or more braids, to a connection terminal, particularly to a connection terminal of a moving contact of a low-voltage circuit breaker or contactor, by laser welding.

Electric circuit breakers and contactors are normally provided with a flexible conductor, which functionally connects a moving contact and a stationary contact. The methods of the background art for providing the junctions of the flexible conductor with the moving contact and with the stationary contact are normally based on braze-welding processes.

These processes generate high temperatures for relatively long times in a relatively large area around the welding region. This causes annealing of the conductor, which is generally made of copper, with a consequent reduction and deterioration of the mechanical characteristics of the flexible conductor, which inevitably leads to a reduction in the useful life of the entire circuit breaker or contactor, requiring complicated maintenance operations or even the replacement of the devices.

The part of the connection terminal that surrounds the welding region, both on the moving contact and on the stationary terminal, is also subjected to the annealing action caused by the heat, with consequent deterioration of the mechanical properties of these components.

Moreover, these processes require a very intensive use of energy and are expensive, scarcely flexible and bulky.

However, it is difficult to find an alternative to these methods that can be performed industrially, since it is a matter of coupling elements that have an irregular shape. For example, in the case of the junction between the conducting braids and the connection terminal of the moving contact, it is necessary to give the connection both a sufficient mechanical stability and the necessary electrical conductivity by using in the best possible manner the usable surfaces of the terminal, and this is not always easy in view of the shape characteristics of the braid. Furthermore, the dimensions of the flexible conductor and of the connection terminal can also be relatively large and accordingly the welding system must have an adequate power level.

Ultrasound welding, for example, does not have the annealing drawbacks cited above, but is not practical to use in view of its known power limits.

It is evident from the above description that in the background art there is the need to have systems for connecting flexible conductors with rigid elements that are a valid alternative to connections obtained by means of conventional braze welding methods. It is also evident that in the background art there is the need to have an efficient method for connecting flexible conductors, particularly copper braids, to connection terminals.

The aim of the present invention is to provide a junction between a flexible conductor and a connection terminal that has high mechanical stability and high electrical conductivity and can be manufactured efficiently.

Within the scope of this aim, an object of the present invention is to provide a method for connecting a flexible conductor to a connection terminal that does not cause degradation of the mechanical properties of the conductor and/or of the connection terminal.

Another object of the present invention is to provide a method for connecting a flexible conductor to a connection terminal that ensures high electrical conductivity.

Another object of the present invention is to provide a junction between a copper braid and a connection terminal in a low-voltage circuit breaker or contactor.

Another object of the present invention is to provide a method for connecting a copper braid to a connection terminal in a low-voltage circuit breaker or contactor.

Another object of the present invention is to provide a method for connecting a flexible conductor to a connection terminal, and a junction between a flexible conductor and a connection terminal, that is simple to apply industrially, at modest costs and in an economically competitive manner.

This application also lends itself to the use of currently widespread low-cost robotized handling units, which introduce great new advantages in terms of flexibility and programmability in a field that up to now was considered extremely inflexible. These characteristics allow, for example, to treat with the same welding station a very different range of connectors and terminals.

This aim, these objects and others that will become better apparent from the description that follows and from the accompanying drawings are achieved by means of a junction between a flexible conductor and a connection terminal, characterized in that it comprises:

- a connection terminal that is shaped substantially like a parallelepiped and has an upper face and a lower face, two side faces and an end face; said end face having one or more slots shaped substantially like a parallelepiped, which run through the entire thickness of said connection terminal;
- at least one flexible conductor, in which one end part is shaped so as to mate substantially with the inner walls of said slots; said end part being inserted in said slots, and said flexible conductor protruding substantially at right angles from one of said upper, lower or end faces;
- at least one laser welding bead, which runs along said connection terminal at said slots along at least one of the two faces from which said flexible conductor does not protrude.

Another aspect of the present invention is a method for providing a junction between a flexible conductor and a connection terminal, characterized in that it comprises the steps that consist in:

- providing a connection terminal that is substantially shaped like a parallelepiped and has an upper face and a lower face, two side faces and an end face, said connection terminal having, on said end face, one or more slots shaped substantially like a parallelepiped which run through the entire thickness of said connection terminal;
- providing at least one flexible conductor in which one end part is shaped so as to substantially mate with the inner walls of said slots;
- inserting and cold-coining said shaped end part in said slots, so that said flexible conductor protrudes substantially at right angles from one of said upper or lower or end faces of said connection terminal;
- subjecting, at said slots, at least one of the faces not affected by the protrusion of said flexible conductor to a welding action of laser means in order to mutually weld said connection terminal and said flexible conductor.

It has in fact been found that by using the junction according to the invention and the method according to the invention, connections characterized by high mechanical stability and high electrical conductivity are provided. The user of laser welding means, moreover, avoids the annealing problems of the background art, consequently preserving the mechanical properties of the individual parts.

Figure 2:
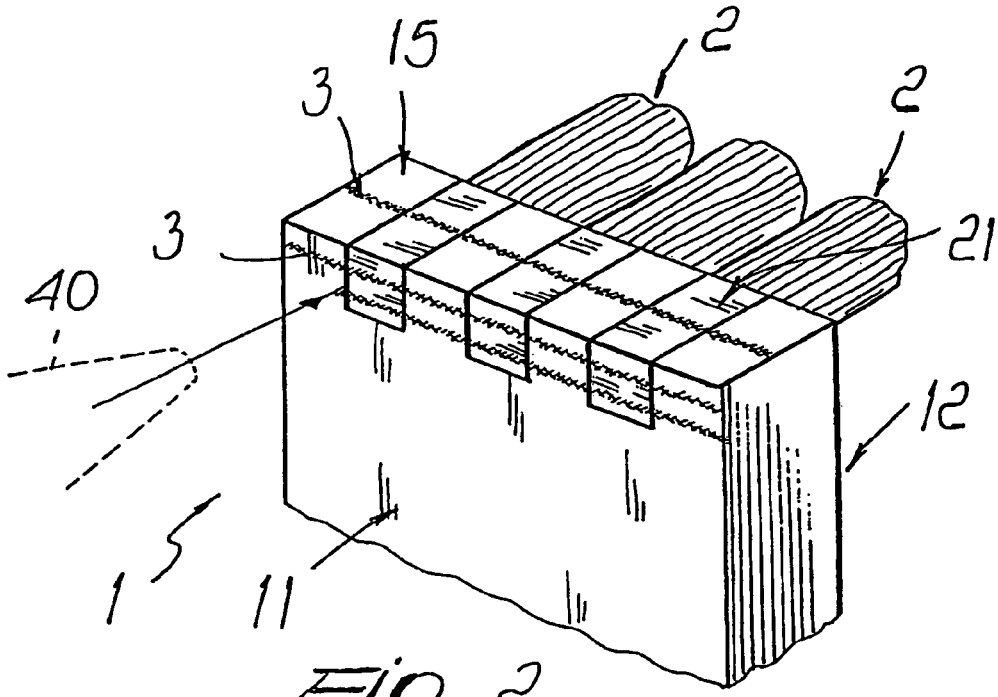

The characteristics of the method according to the present invention will become better apparent with reference to the description that follows and to the accompanying drawings, given merely by way of non-limitative example, and wherein:

FIG. 1 is a schematic perspective view of a connection terminal and of the flexible conductors according to the present invention; and FIG. 2 is a schematic perspective view of a junction between flexible conductors and a connection terminal according to the invention, and of a method according to the invention for providing said junction.

With reference to FIG. 1, the elements that constitute the junction are a connection terminal 1, which is shaped substantially like a parallelepiped, with an upper face 11 and a lower face 12, two lateral faces 13 and 14 and an end face 15. The connection terminal has, on the end face 15, one or more substantially parallelepipedal slots 150, which run through the entire thickness of the connection terminal. In practice, it can be said that the end face 15 has, in the example, a square-wave profile.

A second element that constitutes the junction is a flexible conductor 2, which has an end part 21 that is shaped so as to mate substantially with the inner walls of the slots 150.

With reference to FIG. 2, it is shown that the junction according to the invention is constituted by the end part 21 of the conductor 2 that is inserted in the slots 150. The flexible conductor 2 in this case protrudes substantially at right angles from the lower face 12 of the connection terminal 1.

Again with reference to FIG. 2, at least one laser welding bead 3 runs along the connection terminal 1 at the slots 150 along the end face 15 and/or along the face that lies opposite the one from which the flexible conductor protrudes. In the case of FIG. 2 there are laser welding beads 3 both along the end face 15 and along the upper face 11.

The term "welding bead" designates the molten material generated by the scanning of laser means along preset lines.

Preferably, and as shown schematically in FIGS. 1 and 2, the flexible conductor 2 is constituted by one or more copper braids. As described more clearly hereinafter, the shaped end part 21 of the flexible conductor 2 can be obtained conveniently by compressing said braid.

Especially when the junction is relatively large, it is preferable to provide multiple laser welding beads 3; in this case, it is convenient to have said beads run both along the end face and, for example and with reference to FIG. 2, along the face 11, which in this case is the face that lies opposite the face 12 from which the flexible conductors 2 protrude.

The junctions according to the invention are applied conveniently for example in low-voltage circuit breakers and contactors. Said circuit breakers and contactors, in their most schematic form, comprise at least one moving contact, a flexible conductor, and a connection terminal.

The junctions between the moving contact and the flexible conductor, and between the flexible conductor and the connection terminal, can be constituted conveniently by a junction according to the present invention. Said circuit breakers and contactors constitute a further aspect of the present invention.

Another aspect of the present invention relates to a method for providing a junction between a flexible conductor and a connection terminal and is described in detail hereinafter. With reference to FIGS. 1 and 2, the method according to the invention comprises the following steps. A connection terminal 1 shaped substantially like a parallelepiped is prepared which has an upper face 11, a lower face 12, two side faces 13 and 14 and an end face 15; one or more slots 150 shaped substantially like a parallelepiped are provided on the end face 15 and run through the entire thickness of said connection terminal. Moreover, a flexible conductor 2 is provided which has an end part 21 that is shaped so as to substantially mate with the inner walls of said slots.

The shaped end part 21 is inserted and cold-coined in the slots 150, so that the flexible conductor 2 protrudes substantially at right angles from one of said upper, lower or end faces of the connection terminal, for example from the lower face 12.

With reference to FIG. 2, the end face 15 and/or the lower face 12 are subjected to the welding action of laser means 40 (shown schematically) to provide a weld between the connection terminal and the flexible conductor.

As mentioned, the flexible conductor is preferably constituted by one or more copper braids, and the shaped end part is obtained by compressing said braid.

The welding action is preferably obtained by virtue of the scanning of laser means on the faces 15 and/or 11 or 12, along a direction that is substantially perpendicular to the lateral faces 13 and 14 of the connection terminal. In any case, particularly for relatively large junctions, it is preferable to have the laser means perform multiple scans both on the end face 15 and on the face 11 or 12, along directions that are substantially perpendicular to the lateral faces of the connection terminal.

It is evident to the person skilled in the art that said scanning can be performed by means of a relative movement of the laser means with respect to the components to be welded during the welding operation. Said relative movement in practice can be provided by keeping motionless the components to be welded and moving the laser means, or by keeping motionless the laser means and moving the components to be welded, or by moving both.

The scanning speed, the angle of incidence and all the other physical parameters of the laser beam described in greater detail hereinafter can be chosen and modulated according to the characteristics of the elements to be welded, such as for example their chemical nature or their thickness, but can also be controlled and changed appropriately during the welding operations in order to compensate for the heating of the affected regions and in general in order to optimize the results.

Although it is possible to use laser means of a different type, it is highly preferable to use a solid-state laser, for example a Nd crystal laser. In this case also, the operating characteristics of the laser, such as for example its frequency, power and angle of incidence, scanning speed and angle of incidence, can be chosen and modulated as a function of the characteristics of the elements to be welded and of the results to be obtained.

In practice, it has been found that by using the method according to the invention it is possible to obtain junctions that are excellent in terms of mechanical and electrical properties. In particular, the problems of copper annealing typical of braze welding processes are avoided. In practice, the extremely high electrical conductivity given by cold-coining of the flexible conductors on the connection terminals is safeguarded even after the welding process according to the invention, thus avoiding the deterioration in conductivity that is instead typical of junctions subsequently subjected to the braze welding process. Laser welding is left the task of stabilizing the system mechanically and of preventing the thermal expansions of the materials in operating conditions from compromising the electrical conductivity characteristics.

Furthermore, the use of laser means allows to avoid applications of heat that would be critical and harmful for the mechanical characteristics of the individual components.

The method according to the invention is furthermore suitable for being inserted in automated production cycles, allowing for example to obtain circuit breakers, contactors and components of circuit breakers and contactors efficiently and relatively cheaply.

In practice, it has been found that the junctions according to the invention, as well as the method for obtaining them, fully achieve the intended aim and objects.

The junction and the method thus conceived are susceptible of numerous modifications and variations, all of which are within the scope of the inventive concept; all the details may furthermore be replaced with other technically equivalent elements.

In practice, the materials used, as well as the contingent shapes and dimensions, may be any according to the requirements and the state of the art.

The invention claimed is:

1. A junction between a flexible conductor and a connection terminal, wherein the junction comprises:

a connection terminal that is shaped substantially like a parallelepiped and has an upper face and a lower face, a pair of side faces and an end face; said connection terminal having, on said end face, one or more slots shaped substantially like a parallelepiped, which run through the entire thickness of said connection terminal;

at least one flexible conductor, in which one end part is shaped so as to mate substantially with the inner walls of said slots; said end part being inserted in said slots and cold coined, and said flexible conductor protruding substantially at right angles from one of said upper, lower or end faces;

at least one laser welding bead, wherein said at least one laser welding bead runs across said slots along two faces among said upper face, said lower face, said pair of side faces and said end face from which said flexible conductor does not protrude.

2. The junction according to claim 1, wherein said flexible conductor is constituted by a copper braid.

3. The junction according to claim 2, wherein the end part of said flexible conductor is shaped by compressing said braid.

4. The junction according to claim 1, wherein said at least one laser welding bead comprises a plurality of laser welding beads that run along said two faces.

5. A low-voltage circuit breaker or contactor, comprising at least one moving contact, a flexible conductor, a connection terminal, a first junction between said moving contact and said flexible conductor, a second junction between said flexible conductor and said connection terminal, wherein at least one of said first and second junctions is a junction according to claim 1.

6. The junction according to claim 2, wherein said at least one laser welding bead comprises a plurality of laser welding beads that run along said two faces.

7. The junction according to claim 3, wherein said at least one laser welding bead comprises a plurality of laser welding beads that run along said two faces.

8. A low-voltage circuit breaker or contactor, comprising at least one moving contact, a flexible conductor, a connection terminal, a first junction between said moving contact and said flexible conductor, a second junction between said flexible conductor and said connection terminal, wherein at least one of said first and second junctions is a junction according to claim 2.

9. A low-voltage circuit breaker or contactor, comprising at least one moving contact, a flexible conductor, a connection terminal, a first junction between said moving contact and said flexible conductor, a second junction between said flexible conductor and said connection terminal, wherein at least one of said first and second junctions is a junction according to claim 3.

10. A low-voltage circuit breaker or contactor, comprising at least one moving contact, a flexible conductor, a connection terminal, a first junction between said moving contact and said flexible conductor, a second junction between said flexible conductor and said connection terminal, wherein at least one of said first and second junctions is a junction according to claim 4.

11. A method for providing a junction between a flexible conductor and a connection terminal, wherein the method comprises:

providing a connection terminal that is shaped substantially like a parallelepiped with an upper face and a lower face, a pair of lateral faces and an end face, said connection terminal having, on said end face, one or more slots that are shaped substantially like a parallelepiped and run through the entire thickness of said connection terminal;

providing at least one flexible conductor in which an end part is shaped so as to substantially mate with the inner walls of said slots;

inserting and cold-coining said shaped end part in said slots, so that said flexible conductor protrudes substantially at right angles from one of said upper, lower or end faces of said connection terminal;

subjecting, at said slots, two faces among said upper face, said lower face, said pair of lateral faces and said end face from which the flexible conductor does not protrude to the welding action of laser means to provide a weld between said connection terminal and said flexible conductor, wherein said weld extends across said slots along said two faces.

12. The method according to claim 11, wherein said flexible conductor is constituted by at least one copper braid.

13. The method according to claim 12, wherein the shaped end part of the flexible conductor is obtained by compressing said braid.

14. The method according to claim 11, wherein said laser means scan said two faces along a direction that is substantially perpendicular to the lateral faces of said connection terminal.

15. The method according to claim 14, wherein said laser means perform multiple scans on said two faces along directions that are substantially perpendicular to the lateral faces of said connection terminal.

16. The method according to claim 11, wherein said laser means are constituted by a solid-state laser.

17. A junction between a flexible conductor and a connection terminal, wherein the junction is obtained with a method according to claim 11.

18. The method according to claim 12, wherein said laser means scan said two faces along a direction that is substantially perpendicular to the lateral faces of said connection terminal.

19. The method according to claim 13, wherein said laser means scan said two faces along a direction that is substantially perpendicular to the lateral faces of said connection terminal.

20. The method according to claim 12, wherein said laser means are constituted by a solid-state laser.

21. The method according to claim 13, wherein said laser means are constituted by a solid-state laser.

22. The method according to claim 14, wherein said laser means are constituted by a solid-state laser.

23. The method according to claim 15, wherein said laser means are constituted by a solid-state laser.

24. A junction between a flexible conductor and a connection terminal, wherein the junction is obtained with a method according to claim 12.

25. A junction between a flexible conductor and a connection terminal, wherein the junction is obtained with a method according to claim 13.

26. A junction between a flexible conductor and a connection terminal, wherein the junction is obtained with a method according to claim 14.

27. A junction between a flexible conductor and a connection terminal, wherein the junction is obtained with a method according to claim 15.

28. A junction between a flexible conductor and a connection terminal, wherein the junction is obtained with a method according to claim 16.

* * * * *